US006210037B1

(12) United States Patent
Brandon, Jr.

(10) Patent No.: US 6,210,037 B1
(45) Date of Patent: Apr. 3, 2001

(54) BACK PACK LINER

(76) Inventor: Daniel M. Brandon, Jr., 4007 Willow Run, Palm Beach Gardens, FL (US) 33418

( * ) Notice: Subject to any disclaimer, the term of this patent is extended or adjusted under 35 U.S.C. 154(b) by 0 days.

(21) Appl. No.: 09/492,304

(22) Filed: Jan. 27, 2000

Related U.S. Application Data

(60) Provisional application No. 60/117,236, filed on Jan. 26, 1999.

(51) Int. Cl.[7] ..... B65D 30/08

(52) U.S. Cl. ..... 383/111; 220/495.08; 224/645; 383/2; 383/113; 383/903; 428/131

(58) Field of Search ..... 383/2, 111, 903, 383/113; 428/131, 134–136; 224/153, 645; 190/125; 229/117.35; 220/495.06, 495.08, 495.11

(56) References Cited

U.S. PATENT DOCUMENTS

| | | | | |
|---|---|---|---|---|
| 3,733,024 | * | 5/1973 | Bolling, Jr. et al. | 383/2 |
| 3,948,436 | * | 4/1976 | Bambara | 383/119 |
| 4,573,202 | * | 2/1986 | Lee | 190/125 |
| 4,622,693 | | 11/1986 | Mykleby | 383/119 |
| 4,674,127 | | 6/1987 | Yamada et al. | 383/6 |
| 4,882,213 | * | 11/1989 | Gaddis et al. | 428/136 |
| 4,883,701 | * | 11/1989 | Rankin et al. | 428/136 |
| 4,891,454 | * | 1/1990 | Perdelwitz, Jr. | 428/137 |
| 4,932,556 | * | 6/1990 | Hui et al. | 220/403 |
| 5,149,203 | * | 9/1992 | Sacks | 383/111 |
| 5,472,279 | * | 12/1995 | Lin | 383/2 |
| 5,547,075 | * | 8/1996 | Hoogerwoord | 206/204 |
| 5,628,436 | | 5/1997 | Jones et al. | 224/148.3 |
| 5,639,164 | | 6/1997 | Ishino et al. | 383/22 |
| 5,722,710 | * | 3/1998 | Ralciani | 290/39.1 |

* cited by examiner

*Primary Examiner*—Stephen P. Garbe
(74) *Attorney, Agent, or Firm*—Richard C. Litman

(57) ABSTRACT

A removable one-piece, puncture resistant, flexible inner liner insert for use in a variety of backpacks, soft body portfolios, carrying bags and the like. The liner insert has an adjustable variably sized bottom portion having at least four side regions, at least four stress relief joints, a front flap attached to the first side region of said bottom portion, a back flap attached to the second side region of the bottom portion, and a first side flap and a second side flap attached to the third and fourth side regions of the bottom portion respectively. Additionally, a plurality of size adjusting perforations are located adjacent each of the four joints and run inwardly, at an approximately 45° angle, towards the center of the bottom portion. The size adjusting perforations enable an individual to easily adjust the size of the bottom portion of the liner insert such that it substantially corresponds to the size of the bottom region of the back pack that the liner insert is to be installed within.

10 Claims, 3 Drawing Sheets

BACK PACK LINER

CROSS-REFERENCE TO RELATED APPLICATION

This application claims the benefit of U.S. Provisional Patent Application Serial No. 60/117,236, filed Jan. 26, 1999.

BACKGROUND OF THE INVENTION

1. Field of the Invention

The present invention relates generally to a liner insert, and more specifically, a size adjustable removable liner insert for use in a variety of differently sized and shaped carrying bags.

2. Description of Related Art

Various kinds of soft bodied carrying bags such as soft bodied back packs (or backpacks), luggage, briefcases, portfolios, duffle bags, tool belts and the like are common place today. Often, soft bodied carrying bags are used for a wide array of purposes and within a diverse and wide range of areas such as educationally, industrially, athletically, militarily, recreationally and professionally, to name a few. Soft bodied carrying bags are generally constructed from at least one layer of synthetic woven or knitted fabric-like materials, canvas or fabrics, as well as a combination of these materials.

However, an inherent problem associated with soft bodied carrying bags are their susceptibility to puncture damage from pens, pencils, corners of books or other items having sharpened edges, protrusions, or irregular shapes capable of piercing, puncturing and/or tearing the soft bodied carrying bag. Therefore, there is a great need for a liner insert, preferably removable, that can be inserted and/or installed within a soft bodied carrying bag to prevent inherent puncture related damage caused by sharp edged objects; thereby increasing the useful life span of soft bodied carrying bags.

Examples of various kinds of liners, inner containers or the like, as taught in the prior art are as follows:

U.S. Pat. No. 5,628,436 to Jones et al. issued on May 13, 1997, discloses saddlebags with a removable rigid insulated liner. However, the rigid liner is not size adjustable to fit carrying bags of a different size.

U.S. Pat. No. 4,674,127 to Yamada et al. issued on Jun. 16, 1987, discloses a liner bag used in containers, and employed in the transporting of granular goods or bulk items such as grain and feed stocks. The liner disclosed in Yamada et al. is capable of effectively preventing sagging in the upper face of the liner bag body when installed on the inside of the container. However, the liner bag is not size adjustable to fit different size carrying bags or containers.

U.S. Pat. No. 4,622,693 to Mykleby issued on Nov. 11, 1986, discloses a protective collapsible liner bag, especially well suited to vacuum packaging or modified atmosphere packaging of food products. However, the liner is apparently not readily size adjustable to fit carrying bags of a different size.

U.S. Pat. No. 5,639,164 to Ishino et al. issued on Jun. 17, 1997, discloses a liner used in containers having box-shaped configurations. The liner is bag-shaped and has a ring portion, connection means, and a connection mechanism for connecting the ring portion to the container holding the liner. However, the liner does not appear to be readily size adjustable to fit containers of a different size.

None of the above inventions and patents, taken either singly or in combination, is seen to describe the instant invention as claimed.

SUMMARY OF THE INVENTION

Accordingly, it is a principal object of the invention to provide a removable one-piece, puncture resistant, flexible inner liner insert for use in a variety of soft bodied carrying bags. The liner insert comprises an adjustable variably sized bottom portion having at least four sides, at least four stress relief joints, a front flap attached to the first side of said bottom portion, a back flap attached to a second side of the bottom portion, and a first side flap and a second side flap attached to the third and fourth sides of the bottom portion respectively. Additionally, a plurality of size adjusting perforations can be located at each of the four joints and run inwardly at an approximately 45° angle from the joints toward the center of the bottom portion. The size adjusting perforations enable the size of the bottom portion of the liner insert to be appropriately adjusted, such that the size of the bottom portion of the liner insert substantially corresponds to the size of the bottom region of the soft bodied carrying bag the liner is to be placed within.

It is another object of the invention to provide a versatile one-piece inner liner insert that is removable and capable of being shaped to substantially conform to the body cavity of the carrying bag that the liner is to be placed within.

It is a further object of the invention to provide an inner liner insert that is puncture-resistant to sharp-edged objects, water-resistant, durable and flexible.

It is a further object of the invention to provide an inner liner insert having substantially circular stress relief joints on the bottom portion of the liner inserts to help prevent the liner insert from tearing at these joints.

Still, another object of the invention is to provide a liner insert that can be used with a variety of differently sized and shaped carrying bags due to an adjustable variably sized bottom portion that is capable of substantially corresponding to the bottom portion of the carrying bag.

It is an object of the invention to provide an inner liner insert that can be stored in either a flat or rolled up position when stored outside a carrying bag.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

As used herein, the phrase "soft bodied" describes various carrying bags and the like, constructed from at least one layer of synthetic woven or knitted fabric-like materials, canvas or fabric, as well as a combination of these materials, wherein the liner insert can be used to prevent puncture damage caused by sharp edged objects stored within the soft bodied carrying bags. The expression soft bodied carrying bags is meant to differentiate carrying bags that are inherently susceptible to puncture damage caused by sharp-edged objects because they are constructed from fabric or fabric-like materials, from "hard bodied" carrying bags such as hard bodied luggage, suitcases, briefcases and the like. Hard bodied carrying bags are not inherently susceptible to puncture damage from sharp-edged objects because of a relatively hard shell, usually constructed from a hard plastic, metal or some combination of both, that is capable of preventing piercing damage caused by sharp-edged objects.

While the drawings herein are directed towards a liner insert used in a backpack, this is only an example of a preferable embodiment. The liner insert can be installed in any sort of carrying bag, such as, but not limited to, soft bodied luggage, briefcases, portfolios, duffle bags, tool belts or the like.

The phrase "puncture resistant" as used herein, refers to materials used to construct the liner insert that are resistant to puncturing or piercing damage caused by sharp-edged items placed inside the soft bodied carrying bag. The phrase "puncture resistant materials" as used herein, also generally includes tough durable plastic materials that are sufficiently flexible to permit the liner insert to substantially conform to the inside cavity of a soft bodied carrying bag. The liner insert of the present invention should preferably be made from material(s) that are capable of maintaining a sufficiently rigid shape such that the liner insert will not collapse upon itself when attached within a carrying bag. However, it should be noted that liner can also be constructed from a material that permits the liner to partially collapse on itself when not attached to the inside carrying bag, yet permits the liner to still be adequately functional. Preferably, the puncture resistant material is typically about ¼" thick, but this thickness can vary depending on the material used, so long as the inner liner insert demonstrates adequate puncture resistant properties to sharp-edged objects.

Figure 1:
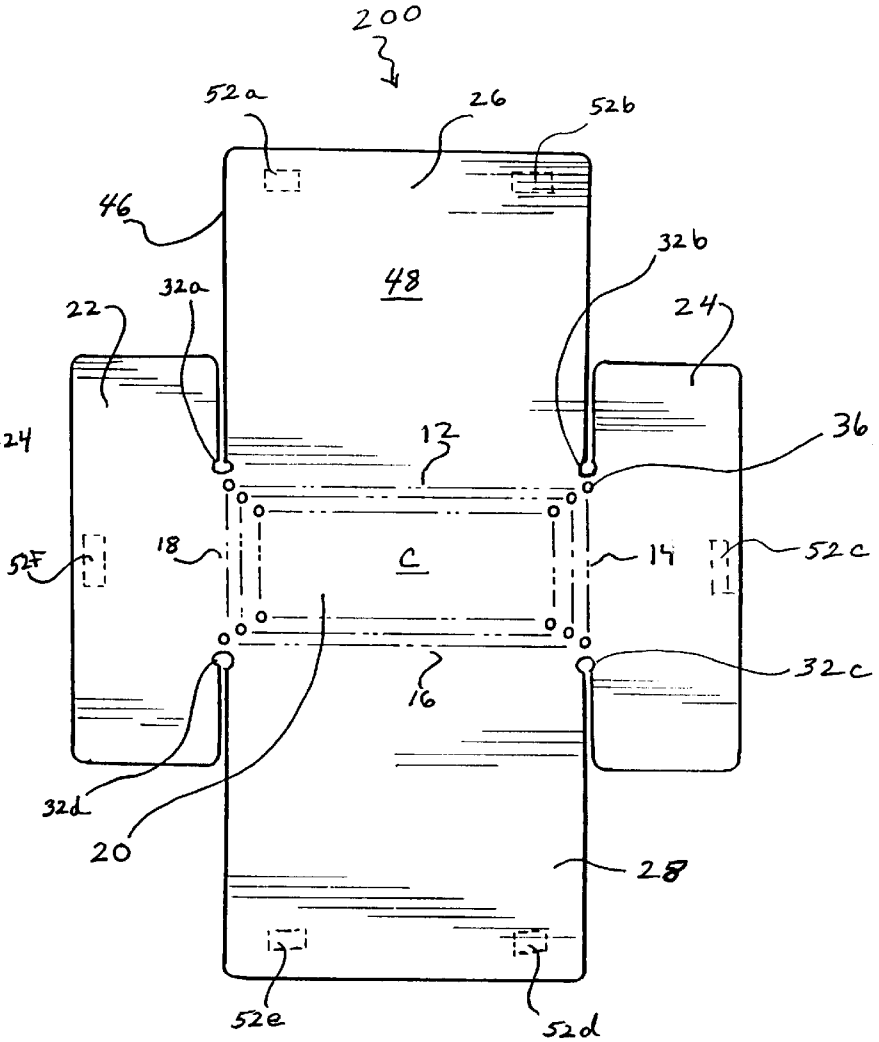
FIG. 1 is a top plan view of one embodiment of a liner insert according to the present invention.

The present invention, as depicted in FIGS. 1–4 is a puncture resistant, one-piece inner liner insert, preferably removable, for use with soft bodied carrying bags such as backpacks and the like. As can be appreciated by one skilled in the art, while the preferred embodiment of the instant liner consists of one-piece, the liner can also consist of two or more separate pieces that can be joined together or used separately. As depicted in FIG. 1, the liner insert 200 comprises an adjustable, variably sized bottom portion 20 having at least four side regions (12,14,16,18), at least four stress relief joints (32*a*–32*d*), a front flap 28 attached to the first side 16 of said bottom portion 20, a back flap 26 attached to a second side 12 of the bottom portion 20, and a first side flap 22 and a second side flap 24 attached to the third 18 and fourth 14 sides of the bottom portion 20, respectively.

Additionally, a plurality of size adjusting perforations 36 can be located at each of the four stress relief joints (32*a*–32*d*) and run inwardly, preferably at an approximately 45° angle, towards the middle or center region C of the bottom portion 20 of the liner insert 200. The plurality of perforations 36 enable the size of 10 the bottom portion 20 to be appropriately adjusted such that the bottom portion substantially corresponds to the size of the bottom region 76 of soft bodied carrying bag, such as a backpack 250, the liner insert 200 is to be placed within. (best seen in FIG. 3) Such is the case if the liner is to large for the back pack it is to be installed within, whereby the size of the base portion of the liner insert has to be adjusted accordingly. This is accomplished by cutting, with a sharp knife, scissors or the like, along the perforations until the size of the base portion of the liner insert 200 substantially matches the size of the bottom region 76 of the back pack the liner insert is to be placed within. The size of the liner 200 is adjusted by starting at the four stress relief joints (32*a*–32*d*) and cutting along the perforations 36 in an inward direction until the bottom portion 20 of the liner 200 substantially corresponds to the bottom region 76 of the back pack 250 the liner 200 is to be placed within. (best seen in FIG. 3) A removable form cushion (not shown) can be disposed beneath the bottom portion 20 of the liner 200 to cushion the bottom region 76 of the back pack 250. Any appropriate cushioning material could be used.

The plurality of perforations 36, as well as the stress relief joints (32*a*–32*d*), have a preferably substantially circular shape and act as stress relief points that distribute the forces applied to each perforation and/or joint equally to all sides respectively, thereby reducing the chance of a tear occurring at any one particular location on the perforation or joint.

As shown in FIG. 1, the liner insert 200 has a front face 48 and a rear face 46. Additionally, the liner insert 200 can have attachment means (52*a*–52*f*) attached to the rear face 46. The attachment means (52*a*–52*f*) can be a variety of fastening elements, such as removable fastening elements like hook and loop fasteners, (VELCRO), snaps and/or buttons, each securely affixed to the inside cavity of the back pack and the rear face of the liner insert. The attachment means can also be permanently mounted fastening elements, such as by stitching or riveting the liner insert to the inside of the back pack or by stitching or riveting the liner insert between the inner and outer shells in the case of a soft side carrying bag that is composed of two or more layers of material. (not shown)

Figure 2:
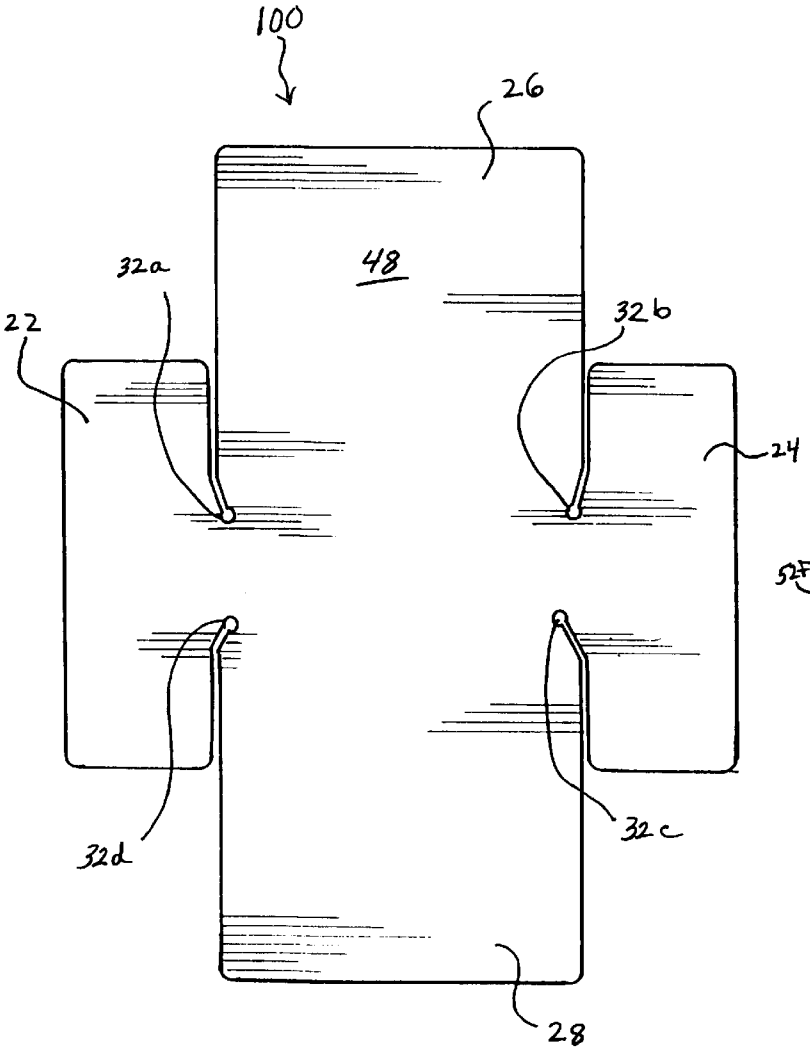
FIG. 2 is a top plan view of another embodiment of a liner insert according to the present invention.

Another embodiment of the current invention is depicted in FIG. 2 and shows an inner liner insert 100 without any size adjusting perforations. Liner insert 100 lacks any size adjusting perforations because it does not have an adjustable variably sized bottom portion. Liner 100 is not meant to fit a variety of differently sized back packs, as liner insert 200 having an adjustable variably sized bottom portion is meant too. Liner insert 100 is constructed in a variety of different sizes that substantially correspond to a variety of differently sized back packs.

Figure 3:
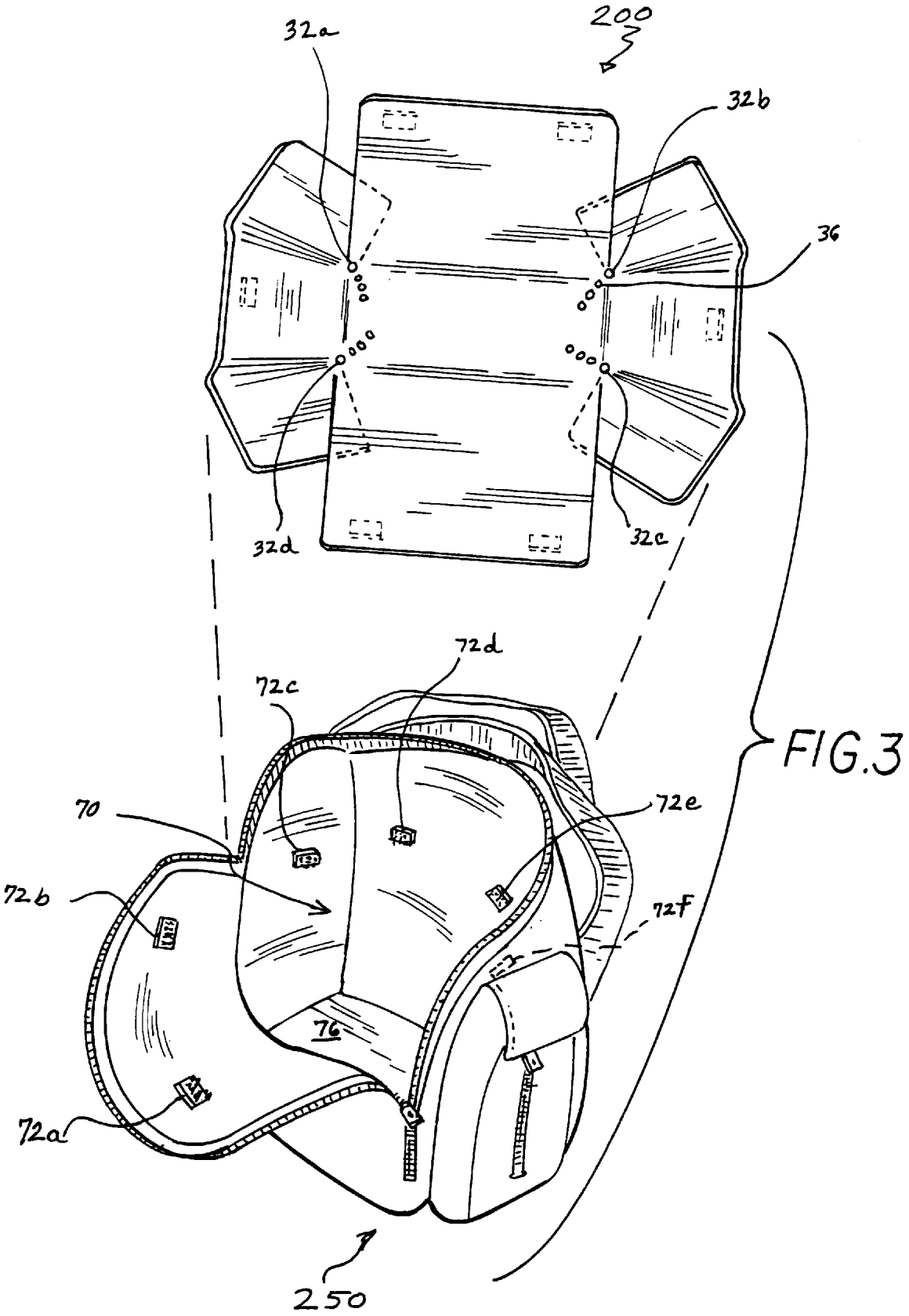
FIG. 3 is an exploded perspective view of one embodiment of the liner insert and a back pack.

FIG. 3 depicts an exploded view of the liner insert 200 and a preferred carrying bag, represented by a back pack 250, having an inside cavity 70, a bottom region 76 and attachment means (72*a*–72*f*) located on the inside cavity of the back pack 250. The attachment means (72*a*–72*f*) are located on the inside of the back pack 250 such that they correspond to the location of the attachment means (52*a*–52*f*) located on the inner face 46 of liner insert 200. The liner insert 200 depicted in FIG. 4 does not show the plurality of perforations 36 seen in FIGS. 1 and 3 because of viewing constraints.

Figure 4:
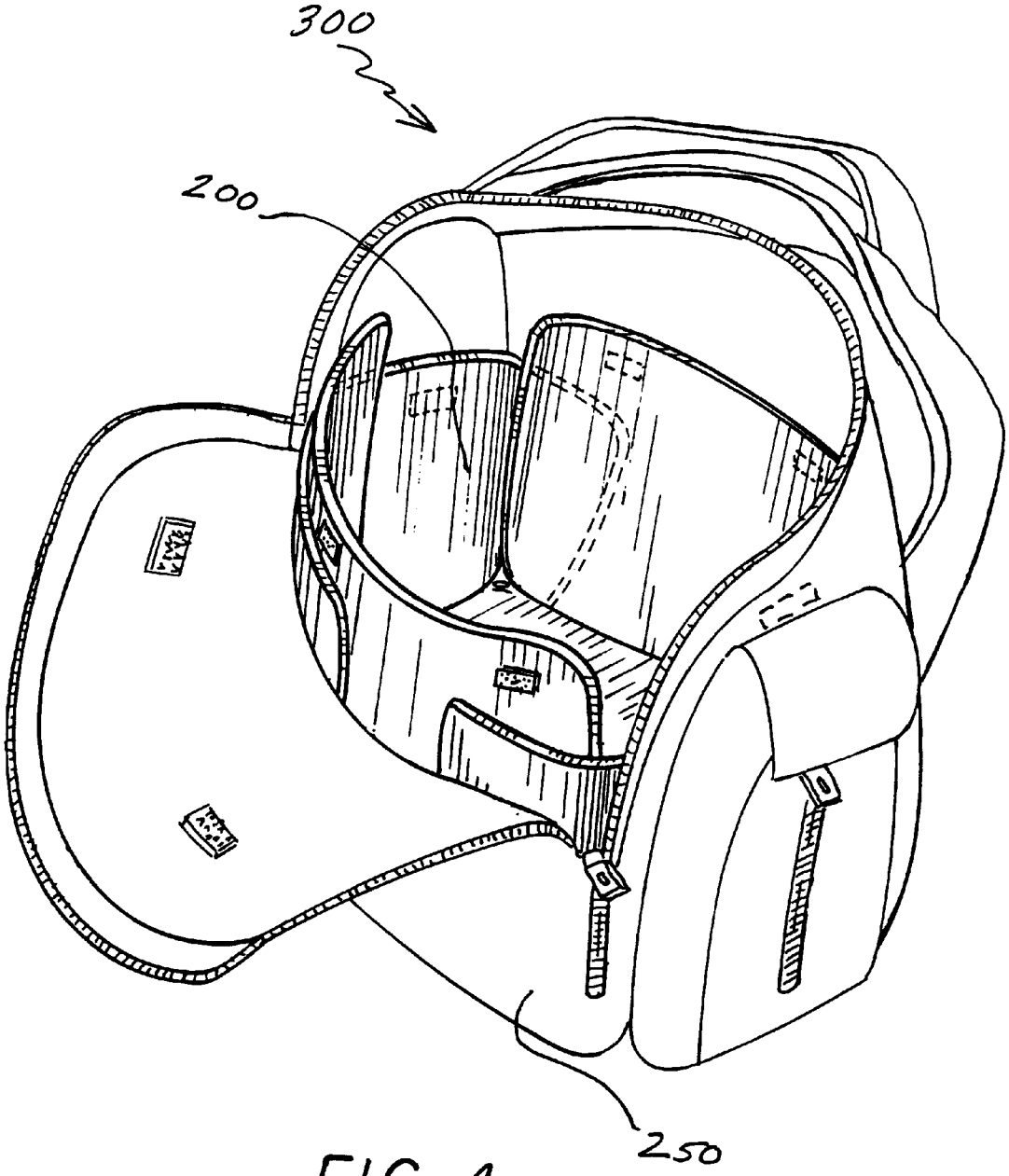
FIG. 4 is an environmental perspective view of the liner insert and back pack shown in FIG. 3, wherein the liner insert is installed in the back pack.

FIG. 4 demonstrates a preferred embodiment 300 representing the liner insert 200 affixed to the inside of back pack 250. In the preferred embodiment 300, attachment means (52*a*–52*f*) of liner insert 200 are attached to attachment means (72*a*–72*f*) of back pack 250; as well recognized by one having ordinary skill in the art, additional points of attachment means may be provided to more securely affix the liner to the inside of the back pack. The liner insert 200 should be positioned within the back pack 250 such that the bottom portion 20 rests adjacent the bottom region 76 of back pack 250 in such a manner that the four stress relief joints (32*a*–32*d*) of liner insert 200 generally correspond to the four corners of the bottom region 76 of the back pack. As previously noted, the liner insert 200 can be attached to the inside of the back pack 250 by a variety of attachment means.

It is to be understood that the present invention is not limited to the sole embodiments described above, but encompasses any and all embodiments within the scope of the following claims.

I claim:

1. A one-piece puncture-resistant liner insert for use inside a soft bodied carrying bag comprising a flexible, one-piece, puncture-resistant liner having a front face and a rear face, the liner including:

an adjustable variably sized bottom portion having at least four side regions and at least four stress relief joints, said at least four stress relief joints forming four corresponding corners;

a front flap attached to a first side region of said bottom portion;

a back flap attached to a second side region of said bottom portion;

a first side flap and a second side flap attached to a third side region and fourth side region of said bottom portion respectively;

a plurality of perforations located at each corner of the bottom portion; and attachment means located on said rear face for attaching the liner insert to the inside of a soft bodied carrying bag;

wherein said perforations enable the bottom portion of said liner insert to substantially correspond to the size of the bottom region of a soft bodied carrying bag.

2. The removable liner insert according to claim 1, wherein said attachment means are securely affixed to said rear face of said front flap, said back flap, said first side flap and said second side flap.

3. The removable liner insert according to claim 1, wherein said attachment means is hook and loop fastening material.

4. The removable liner insert according to claim 1, wherein said liner is made from a flexible and puncture-resistant material.

5. The removable liner insert according to claim 1, wherein said at least four stress relief joints each have a substantially circular shape.

6. In combination a one-piece puncture-resistant liner insert and soft bodied carrying bag comprising:

a soft bodied carrying bag having an inside cavity, a bottom region and inner attachment means; and a liner insert comprising:

an adjustable variably sized bottom portion having at least four sides, at least four stress relief joints and a plurality of perforations;

a front flap attached to a first side region of said bottom portion;

a back flap attached to a second side region of said bottom portion;

a first side flap and a second side flap attached to a third side region and a fourth side region of said bottom portion respectively; and attachment means for attaching said liner insert to the inside cavity of said soft bodied carrying bag at said inner attachment means;

wherein said perforations enable the bottom portion of said liner insert to substantially correspond to the size of the bottom region of said soft bodied carrying bag.

7. In combination a one-piece puncture-resistant liner insert and soft bodied carrying bag according to claim 6, wherein said attachment means is hook and loop fastening material.

8. In combination a one-piece puncture-resistant liner insert and soft bodied carrying bag according to claim 6, wherein said liner is made from a flexible and puncture-resistant material.

9. A puncture-resistant liner insert for use inside a soft bodied carrying bag comprising a flexible, one-piece, puncture-resistant liner having a front face and a rear face, the liner including:

an adjustable variably sized bottom portion having at least four side regions and at least four stress relief joints, said at least four stress relief joints forming four corresponding corners;

a front flap attached to a first side region of said bottom portion;

a back flap attached to a second side region of said bottom portion;

a first side flap and a second side flap attached to a third side region and fourth side region of said bottom portion respectively; and a plurality of perforations located at each corner of the bottom portion;

wherein said perforations enable the bottom portion of said liner insert to substantially correspond to the size of a bottom region of a soft bodied carrying bag the liner is to be placed within.

10. A puncture-resistant liner insert according to claim 9, wherein said liner is made from a flexible and puncture-resistant material.

* * * * *